US007976214B2

(12) United States Patent
Hiranuma et al.

(10) Patent No.: US 7,976,214 B2
(45) Date of Patent: Jul. 12, 2011

(54) PORTABLE WATCH

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/592,432

(22) Filed: Nov. 24, 2009

(65) Prior Publication Data

US 2010/0142332 A1 Jun. 10, 2010

(30) Foreign Application Priority Data

Nov. 26, 2008 (JP) ..... 2008-300717

(51) Int. Cl.
*G04B 37/00* (2006.01)

(52) U.S. Cl. ..... 368/309; 368/276

(58) Field of Classification Search ..... 368/296, 368/276, 309–313
See application file for complete search history.

(56) References Cited

U.S. PATENT DOCUMENTS 1,332,547 A * 3/1920 Eizerman ..... 418/135
3,633,355 A * 1/1972 Sakata ..... 368/296
4,668,101 A * 5/1987 Wuthrich ..... 368/296
4,945,523 A * 7/1990 Lam ..... 368/285
5,224,078 A * 6/1993 Mallin ..... 368/223
5,305,292 A * 4/1994 Reynoso ..... 368/281
5,923,622 A * 7/1999 Chung ..... 368/276
6,761,479 B2 * 7/2004 Meyrat et al. ..... 368/281
7,399,115 B2 * 7/2008 Mavilla et al. ..... 368/309
2007/0189127 A1 * 8/2007 Pollak ..... 368/294
2009/0303843 A1 * 12/2009 Albano ..... 368/281

* cited by examiner

*Primary Examiner* — Sean Kayes
(74) *Attorney, Agent, or Firm* — Adams & Wilks

(57) ABSTRACT

A portable watch has a watch case body having front and back sides. A time display portion is disposed at the front side of the case body for displaying time. The back side of the case body has a lid-receiving surface and a concavity that opens at the lid-receiving surface. A back lid is disposed on the lid-receiving surface to close the interior of the watch case body from the back side thereof, and the back lid has marking indicia and a projection that engages with the concavity in the back side of the watch case body to position the back lid in a predetermined position in which the marking indicia align with the 12 o'clock to 6 o'clock direction of the time display portion. A holding ring is threaded onto the watch case body with the back lid clamped therebetween to removably attach the back lid to the watch case body while maintaining the back lid in the predetermined position.

17 Claims, 6 Drawing Sheets

PORTABLE WATCH

BACKGROUND OF THE INVENTION a) Field of the Invention

The present invention relates to a portable watch such as a wristwatch or a pocket watch and, more specifically, to a portable watch in which a back lid is mounted by screwing in a body in which a watch movement is stored.

b) Description of the Related Art

A back lid of a wristwatch generally has a lid marking such as a logo or the like formed by embossing or graving on a front surface thereof. In order to enhance the appearance quality of the wristwatch, the orientation of the lid marking on the back lid is required to align a 12 o'clock to 6 o'clock direction of the wristwatch.

In order to do so, a technology in the related art to correct an alignment of the back lid with respect to a vertical axis passing through 12 o'clock and 6 o'clock of the back lid is known (for example, see Patent Document 1).

According to the technology disclosed in Patent Document 1, there is provided an interposed component pushed inward into a lower portion of an intermediate member (body) of a wristwatch case, and this component is provided so as to be rotatable with respect to the intermediate member and the back lid is mounted by screwing in the intermediary component. The interposed component includes a substantially ring-shaped elastic blocking member, and a substantially ring-shaped metallic component arranged concentrically within this member. A projecting portion over an entire outer periphery of the elastic blocking member is fitted into a grove on the intermediate member, and the back lid is screwed in the metallic component.

Therefore, the back lid and the metallic component fixed to each other can be rotated with respect to the elastic blocking member in a state in which the back lid is screwed completely in the metallic component. This rotation causes the back lid to rotate with respect to the intermediate member, so that the alignment of the back lid is corrected.

Patent Document, JP-A-2003-57365 (Paragraph 0005 to 0039, FIG. 1 to FIG. 8), discloses a technology to align the orientation of the lid marking on the back lid with the 12 o'clock to 6 o'clock direction of the wristwatch by correcting the alignment of the back lid with respect to the vertical axis passing through the 12 o'clock and 6 o'clock of the wristwatch. Therefore, when assembling the wristwatch, it is inevitable to perform a back lid alignment correcting operation.

OBJECT AND SUMMARY OF THE INVENTION

It is an object of the present invention to provide a watch which can be assembled with the orientation of a lid marking on a back lid aligned with a 12 o'clock to 6 o'clock direction of a wristwatch without the necessity of a back lid alignment correcting operation.

A portable watch including a back lid screwed into a body and formed with a lid marking to be arranged so as to be aligned with a 12 o'clock to 6 o'clock direction of a time display portion, characterized in that the body includes an annular lid mounting portion having a thread and a lid receiving surface on the side of the interior of the body with respect to the thread, the back lid includes a lid plate having an annular projection continued in a circumference direction, being superimposed on the lid receiving surface, and having the lid marking on a front surface thereof, and a holding ring having a thread to be meshed with the thread, being mounted on the lid mounting portion by screwing the same, and clamping the annular projection in cooperation with the lid plate to fix the lid plate, and the lid mounting portion includes a detent portion, the lid plate includes an engaging portion to be engaged with the detent portion, and the lid marking on the front surface of the back lid is provided so as to be aligned with the 12 o'clock to 6 o'clock direction in a state in which the engaging portion and the detent portion are engaged with each other.

In the present invention, the detent portion of the lid mounting portion indicates a configuration functioning as a stopper for preventing the lid plate from being accompanied with the holding ring by a rotating operation for tightening the holding ring when the holding ring is screwed into the lid mounting portion in a state in which the engaging portion of the lid plate is engaged.

In the present invention, when the detent portion and the engaging portion of the lid plate to be engaged therewith have a configuration to be engaged with depression and projection engagement, an engaged position must simply be provided at least at one position, and one of the detent portion and the engaging portion can be formed of a projection and the other one of those can be formed of a depression.

In addition, in the present invention, when the engaging portion of the lid plate is formed of the projection or the depression, the engaging portion can be formed of a projection projecting from a peripheral edge of the lid plate or a notched depression which is opened on the peripheral edge of the lid plate, whereby the detent portion can be formed of and implemented by the depression or the projection.

Also, in the present invention, when forming the engaging portion of the lid plate with the projection, it can be implemented by providing the projection so as to project from a back surface of the peripheral portion of the lid plate, and providing the detent portion formed of a depression opening on the lid receiving surface corresponding thereto on the lid mounting portion. In addition, in contrast to it, when the thickness of the lid plate is sufficient, it can also be implemented by providing the engaging portion formed of the depression so as to project from the back surface of the peripheral portion of the lid plate, and providing the detent portion formed of the projection corresponding thereto on the lid receiving surface.

In the present invention, the detent portion and the engaging portion to be engaged therewith are not limited to the configuration of the depression and projection engagement. For example, it is also possible to form the annular projection which defines the outline shape of the lid plate into an even-numbered or integer-numbered polygonal shape such as a hexagon or an octagon, and provide an annular wall portion having a polygonal inner peripheral surface corresponding thereto on the lid mounting portion. In this case as well, respective angular portions of the annular projection are used as the engaging portions, and respective angular portions interposed between two adjacent surfaces of an inner peripheral surface of the annular wall portion are used as the detent portion. In addition, it is also possible to provide a tooth portion (engaging portion) on at least part of the annular projection, and form the annular projection into a gear shape, for example, and provide a tooth portion (positioning portion) corresponding thereto on an inner periphery of the annular wall portion to implement the wall portion in the form of an internal gear. When implementing the invention in these forms, marks may be provided at predetermined positions on the engaging portion and the positioning portion by marking so as to be able to distinguish these from engaging portions and positioning portions at other positions, thereby correlating with the lid marking.

In the present invention, the detent portion and the engaging portion are preferably provided so as to be aligned with the 12 o'clock to 6 o'clock direction of the time display portion such as an hour plate, in other words, on a line passing through the 12 o'clock and 6 o'clock. However, the detent portion and the engaging portion may be provided at positions deviated from the 12 o'clock to 6 o'clock direction as long as the engaging portion and the lid marking are correlated so that the lid marking is aligned with the 12 o'clock to 6 o'clock direction in the state in which the engaging portion and the detent portion are engaged with each other.

In order to fix the back lid to the body, first of all, the lid plate is superimposed on the lid receiving surface of the lid mounting portion of the body, and the engaging portion of the lid plate is engaged with the detent portion of the lid mounting portion. With this engagement, the lid plate is positioned so as not to rotate in the circumferential direction of the body, and the lid marking of this lid plate is positioned in a state of being aligned with the 12 o'clock to 6 o'clock direction of the portable watch. Subsequently, the thread of the holding ring is meshed with the thread of the lid mounting portion, and the holding ring is screwed therein. Accordingly, since a portion of the holding ring on the side of an inner peripheral portion clamps the annular projection in cooperation with the lid receiving surface, the holding ring is mounted on the lid mounting portion. In other words, the back lid is fixed to the body. When operating the latter, a rotational force of the holding ring acts on the lid plate. Irrespective of this configuration, since the engaging portion is engaged with the detent portion, the lid plate is not rotated by the holding ring. Therefore, the state in which the lid marking is aligned with the 12 o'clock to 6 o'clock direction is maintained, so that the mounting of the back lid to the body is completed.

As described thus far, according to the present invention, the lid marking is positioned in the state of being aligned with the 12 o'clock to 6 o'clock direction and the back lid is fixed to the body while maintaining this state with such simple labor as engaging the engaging portion of the lid plate with the detent portion of the lid mounting portion. Therefore, assembly with the orientation of the lid marking of the back lid aligned with the 12 o'clock to 6 o'clock direction of the wristwatch is achieved without the necessity of a back lid alignment correcting operation.

According to the preferred embodiment of the present invention, the lid mounting portion includes an annular wall portion which partitions the lid receiving portion and allows the annular projection to be fitted therein, and the detent portion is provided on the wall portion.

According to the preferred embodiment, by fitting the annular projection of the lid plate inside the annular wall portion, the lid plate can be positioned radially with respect to the body and the lid plate can be superimposed on the lid receiving surface. Then, since the detent portion of the wall, portion is not covered with the lid plate, there is an advantage such that the engaging portion of the lid plate can be engaged with the detent portion easily while viewing the detent portion, whereby positioning to the state in which the lid marking is aligned with the 12 o'clock to 6 o'clock direction as described above is achieved.

In the preferred embodiment of the present invention, the detent portion is formed of depressions opened on an end surface of the wall portion and an inner peripheral surface of the wall portion respectively, and the engaging portion is formed of a projection projecting from the annular projection.

In this preferred embodiment, when fabricating the detent portion formed of the depression on the annular wall portion, it can be fabricated easily by performing a working to depress the position to be provided with the detent portion by cutting or the like. Also, in order to provide the engaging portion formed of the projection on the annular projection of the lid plate, for example, it can be provided simultaneously with punching the lid plate via a press work. Therefore, workability of the detent portion and the engaging portion is good and so that reduction of the fabrication cost is advantageously reduced.

In the preferred embodiment of the present invention, only one engaging portion is provided at a peripheral portion of the lid plate so as to be visible, and the lid marking on the front surface of the back lid is provided so as to be aligned with the 12 o'clock to 6 o'clock direction in correlation with the engaging portion in the state in which the engaging portion is engaged with the detent portion.

In the preferred embodiment, since there is provided the single engaging portion on the lid plate, when forming the lid marking on the front surface of the lid plate having the engaging portion by graving or the like, the lid marking can be provided so as to be correlated with the single engaging portion as a rough standard. Therefore, by mounting the back lid on the body to engage the engaging portion with the detent portion, the lid marking can be aligned with the 12 o'clock to 6 o'clock direction as described above.

In the preferred embodiment of the present invention, the lid mounting portion is formed with an annular groove opening on the lid receiving surface positioned on the side of the interior of the body with respect to the thread of the lid mounting portion, and an annular water-proof packing fitted into this groove is brought into tight contact with a back surface of the lid plate.

In this preferred embodiment, in order that water passed through the portion between the lid plate and the holding ring reaches the water-proof packing, the annular wall portion and the lid receiving surface need to flow along the annular projection of the lid plate, and in order that water passed through a portion between the holding ring and the body reaches the water-proof packing, it needs to flow along the annular wall portion of the body to which the annular projection is in contact. Anyway, since an entry path of water up to the water-proof packing assumes a labyrinth shape, improvement of water-proof properties with respect to the interior of the body on the side of the back lid is advantageously achieved.

According to the watch of the present invention, assembly with the orientation of the lid marking of the back lid aligned with the 12 o'clock to 6 o'clock direction of the wristwatch is achieved without the necessity of the back lid alignment correcting operation.

DESCRIPTION OF THE PREFERRED EMBODIMENTS

Referring now to FIG. 1 to FIG. 6, an embodiment of the present invention will be described.

Figure 1:
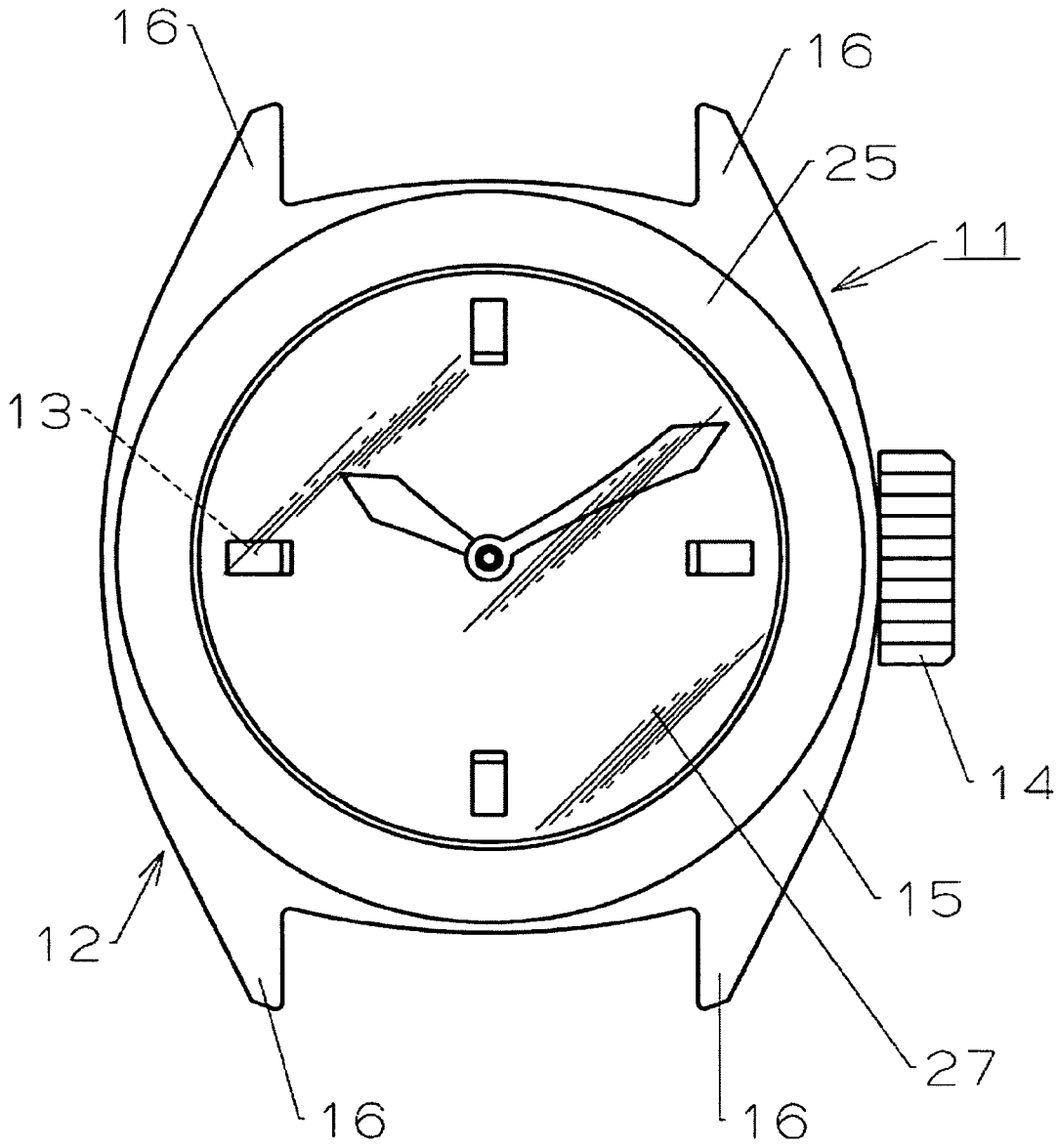
FIG. 1 is a front view showing a wristwatch according to an embodiment of the present invention.
Figure 2:
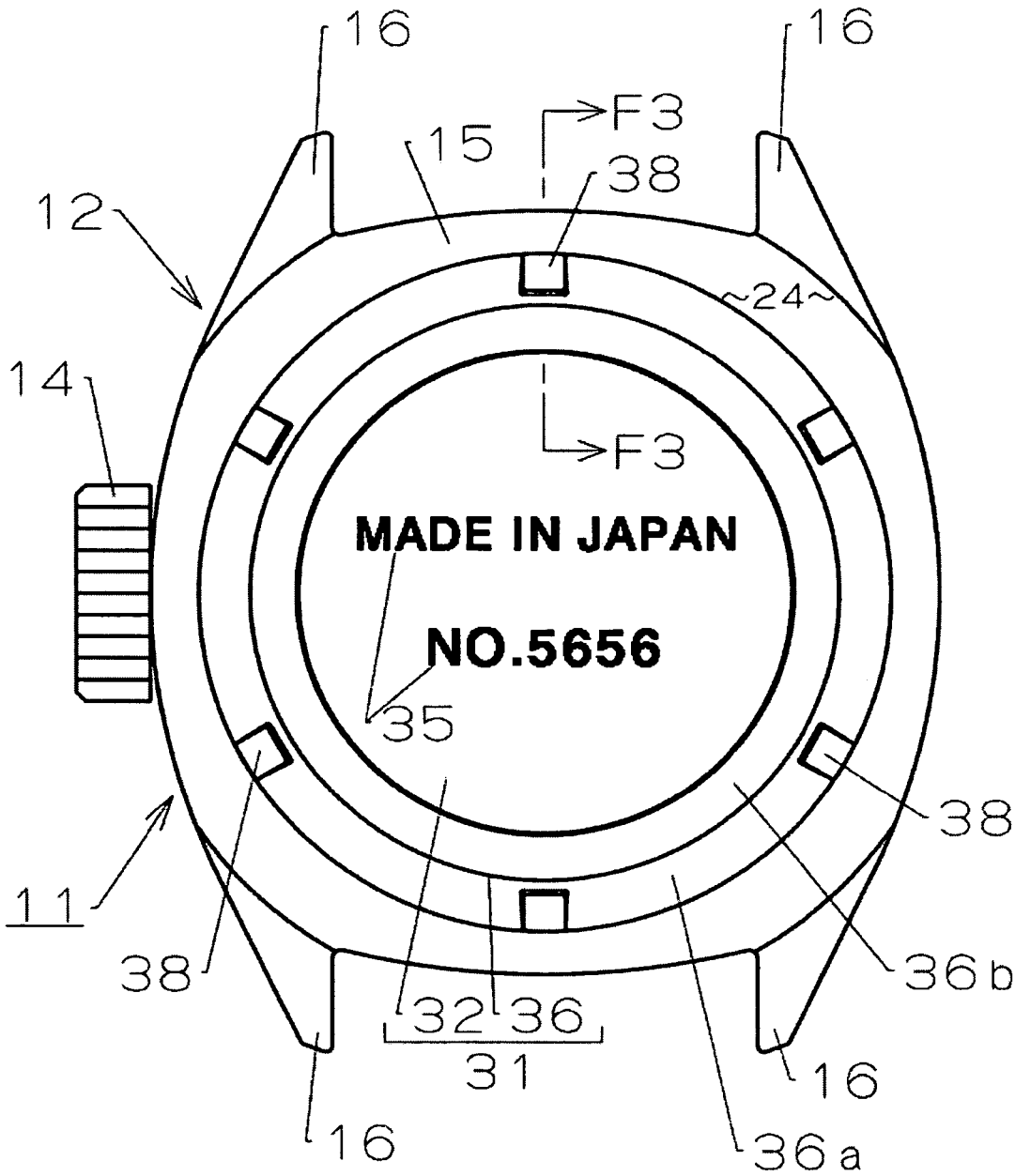
FIG. 2 is a back surface view showing the wristwatch in FIG. 1.

Reference numeral 11 in FIG. 1 and FIG. 2 designates a portable watch, for example, a wristwatch. A time display portion, for example, an hour plate 13 (see FIG. 1) and a watch movement or the like, not shown, are stored in a watch sheath assembly 12 of the wristwatch 11, and a winder 14 positioned in a direction of 3 o'clock of the hour plate 13 for operating the watch movement is mounted on the watch sheath assembly 12.

The watch sheath assembly 12 includes a watch case body 15, an edge member 25, a transparent cover in the form of a glass 27, and a back lid 31. The body 15 is formed of a metal such as stainless steel or titanium. The body 15 includes pairs of projections 16 each opposing in a 9 o'clock to 3 o'clock direction of the watch sheath assembly 12 integrally provided so as to project in directions of 12 o'clock and 6 o'clock, respectively. Belts or bands, not shown, for securing the wristwatch 11 on a wrist of the human body are attached to the projections 16.

As shown in FIG. 1, the edge member 25 is formed into a ring shape, and is fixed to the body 15 so as to be exposed from the side of a front surface of the body 15. The glass 27 for allowing an hour plate 13 to be seen through is mounted inside the edge member 25.

The body 15 has an annular shape and is provided with a lid mounting portion 17 and a first lid receiving surface 24 which surrounds the lid mounting portion 17 on a back side portion thereof. The first lid receiving surface 24 is a flat surface, and protrudes horizontally from the root of the lid mounting portion 17.

Figure 3:
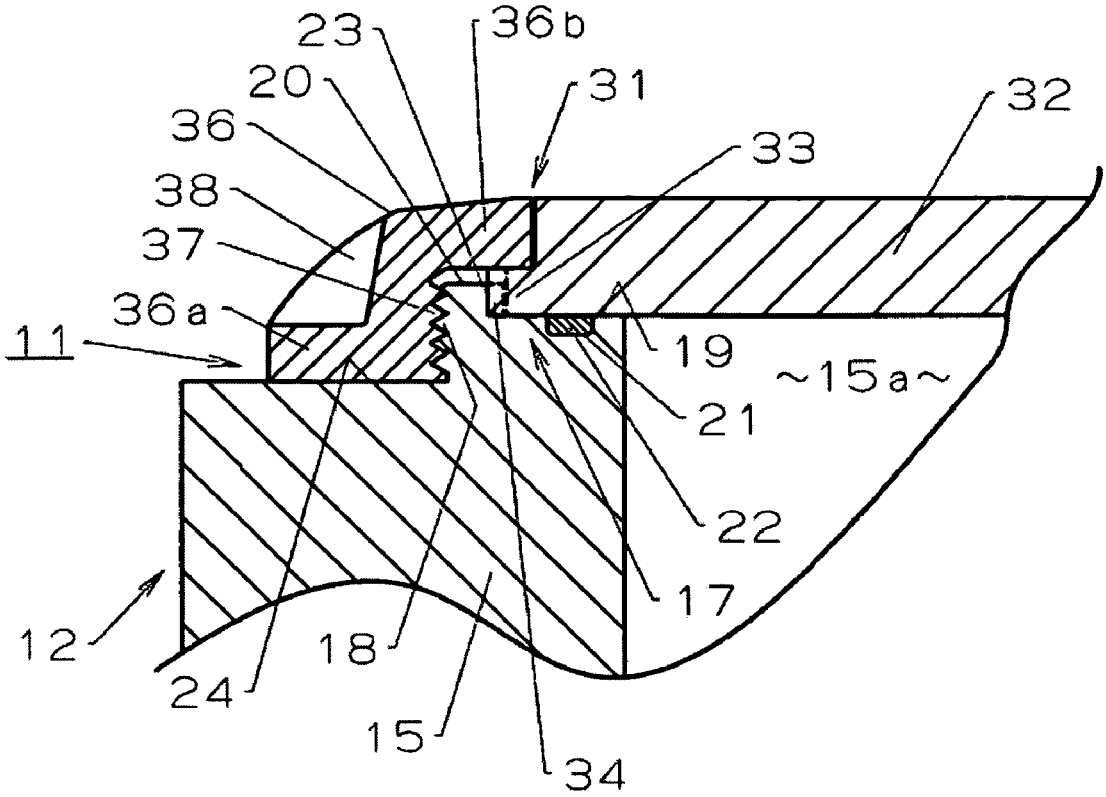
FIG. 3 is a cross-sectional view of the back lid side taken along the line F3-F3 in FIG. 2.
Figure 4:
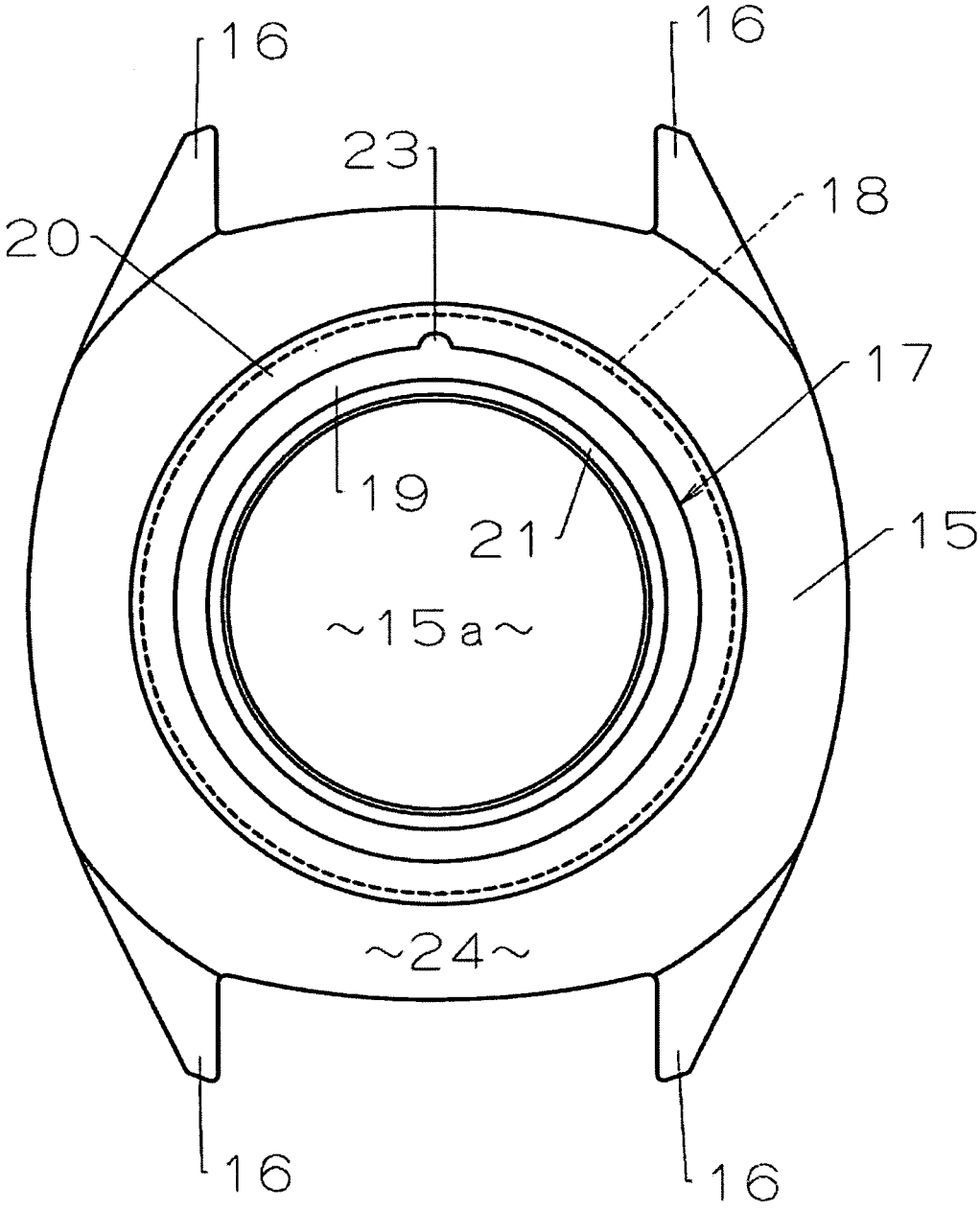
FIG. 4 is a back surface view showing a body of the wristwatch in FIG. 1.

As shown in FIG. 4, the lid mounting portion 17 surrounds an interior 15*a* of the body 15, and is formed into an annular shape. As shown in FIG. 3 and FIG. 4, a thread or threaded section 18 is formed in an outer periphery of the lid mounting portion 17. The lid mounting portion 17 has a second lid receiving surface 19 and an annular wall portion 20.

The second lid receiving surface 19 is a flat surface, and is provided at a level different from the first lid receiving surface 24, more specifically, on the back side with respect to the first lid receiving surface 24 (upper side in FIG. 3). Thus, in this embodiment, the first and second lid receiving surfaces 24 and 19 are not coplanar with each other. The wall portion 20 partitions the second lid receiving surface 19, and is provided to form a boundary between the second lid receiving surface 19 and the thread 18. Therefore, the second lid receiving surface 19 is provided on the side of the interior 15*a* of the body 15 with respect to the thread 18, and is provided so as to be depressed with respect to the wall portion 20.

An annular groove 21 which opens the second lid receiving surface 19 is provided on the lid mounting portion 17. An annular water-proof packing 22 is fitted into the groove 21. The water-proof packing 22 is formed of an elastic material such as rubber or elastomer.

A detent portion 23 is provided at a predetermined portion of the annular wall portion 20 of the lid mounting portion 17. The detent portion 23 in this embodiment is positioned on a line passing through 12 o'clock and 6 o'clock of the hour plate 13, and is provided only one on the side of 12 o'clock. The detent portion 23 is in the form of a concavity or depression opened, for example, on an inner peripheral surface and a distal end surface of the wall portion 20, respectively, and extends over the entire length of the wall portion 20 in the height direction. Therefore, a bottom surface of the detent portion 23 and the second lid receiving surface 19 are flush with each other as shown in FIG. 3.

The back lid 31 includes a lid plate 32 and a holding ring 36 as shown in FIG. 2 and FIG. 3. The lid plate 32 and the holding ring 36 are formed of metal or synthetic resin of the same kind as or a different kind from the body 15 and, in this embodiment, are formed of metal.

Figure 5:
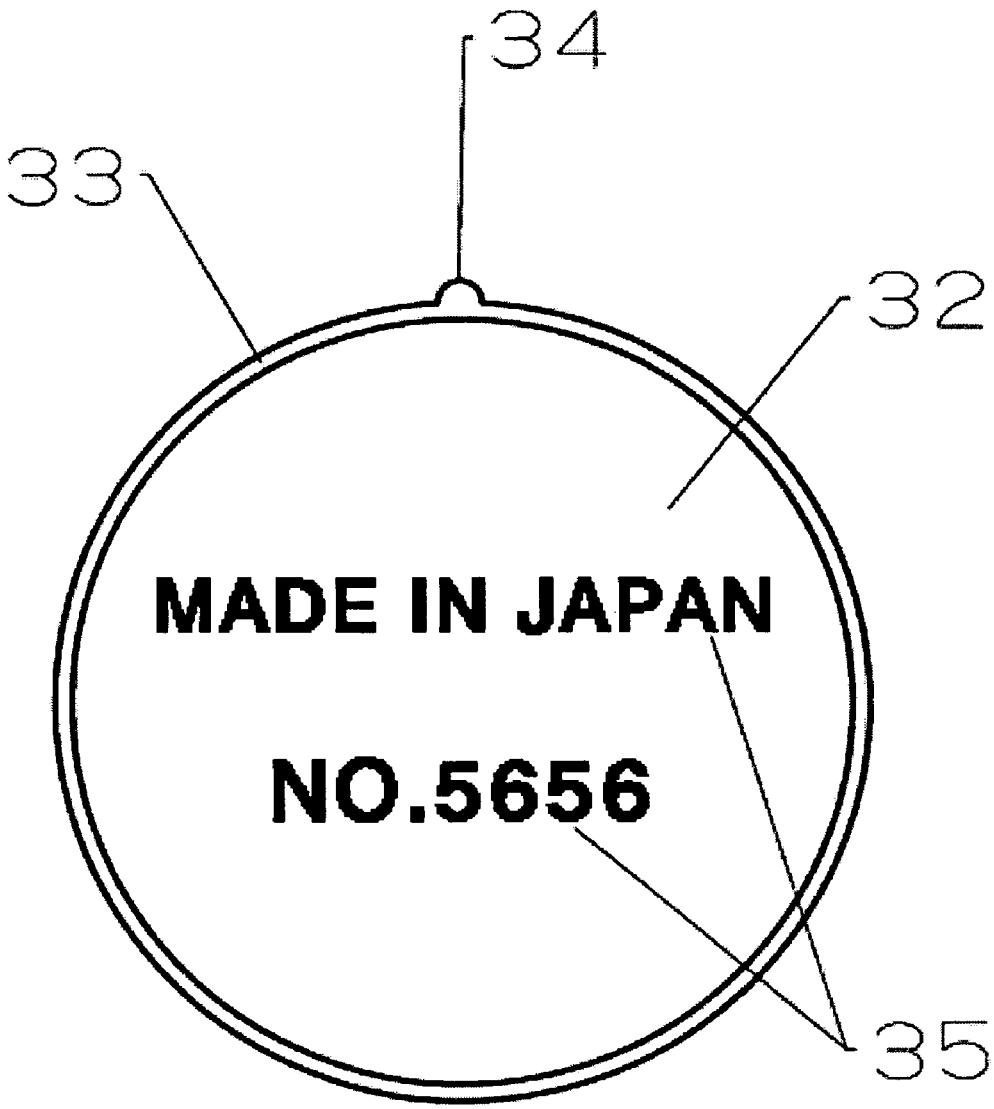
FIG. 5 is a front view showing a lid plate of the back lid provided on the wristwatch in FIG. 1.
Figure 6:
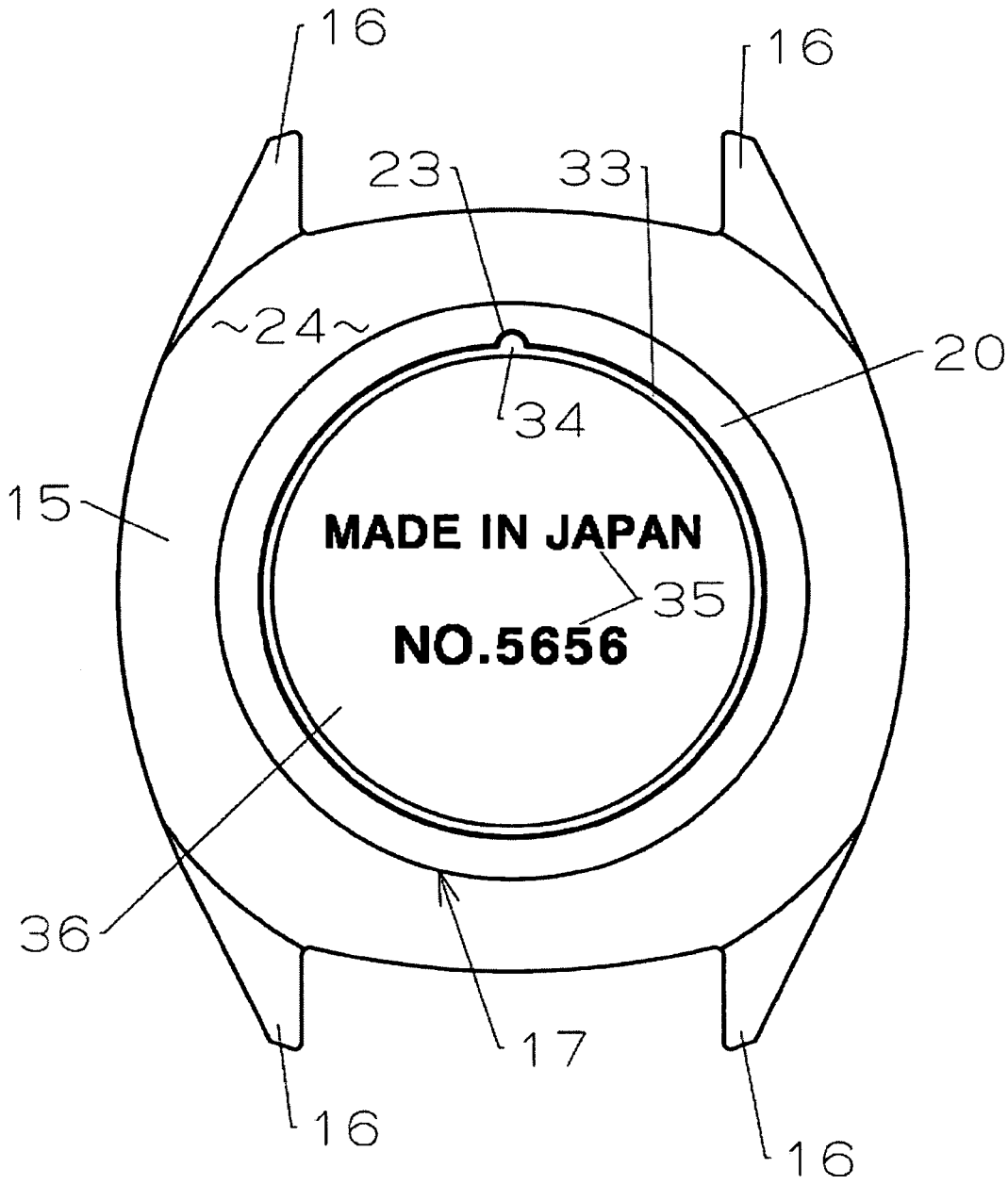
FIG. 6 is a back surface view showing the body combined with the lid plate in FIG. 5.

As shown in FIG. 5 and FIG. 6, the lid plate 32 is formed of a disk, and the diameter thereof matches the size of the second lid receiving surface 19. A peripheral portion of the lid plate 32 is formed into a shouldered shape with an annular projection 33 provided on a lower portion (in FIG. 3) of the peripheral portion. The annular projection 33 continues in a circumferential direction of the lid plate 32. A back surface of the lid plate 32 is flat, and the back surface of the peripheral portion of the lid plate 32 is defined by a back surface of the annular projection 33.

As shown in FIG. 3, the thickness of the annular projection 33 is larger than the heightwise dimension of the wall portion 20. Accordingly, a front surface of the lid plate 32 and a front surface of a cover portion 36*b*, described later, continue in flush with each other. However, the invention is not limited thereto, and it is also possible to change the thickness of the cover portion 36*b*, described above to make the front surface of the cover portion 36*b* and the front surface of the lid plate 32 continue with a slight level difference therebetween.

An engaging portion 34 to be engaged with the detent portion 23 is provided on the lid plate 32. In other words, the engaging portion 34 is formed by a projection projecting from the annular projection 33 in a radial direction of the lid plate 32. As shown in FIG. 3, the height (thickness) of the engaging portion (projection) 34 is greater than that of the detent portion (concavity) 23. In the case of this embodiment, a single (one) engaging portion 34 is provided, and the engaging portion 34 has a form corresponding to the shape of the detent portion 23. The engaging portion 34 is visible on the lid plate 32 in a stand-alone basis.

As shown in FIG. 5, a lid marking (marking indicia) 35 is provided on the front surface of the lid plate 32. The lid marking 35 includes a country of manufacture and a manufacturer's serial number or a mark (not shown), and so on of the wristwatch 11, and the lid marking 35 shown in the drawing includes a character string arranged in the lateral direction. The lid marking 35 is formed on the front surface of the lid plate 32 by embossing or graving.

The lid marking 35 is correlated with the engaging portion 34 so as to be aligned with the 12 o'clock to 6 o'clock direction in a state in which the engaging portion 34 is engaged with the detent portion 23. In the example shown in FIG. 5, since the engaging portion 34 projects upward, the lid marking 35 is provided so as to be oriented in the same direction.

As described above, since there is provided the single engaging portion 34 on the lid plate 32, when forming the lid marking 35 on the front surface of the lid plate 32 having the engaging portion 34 by graving or the like, the lid marking 35 can be provided so as to be correlated with the single engaging portion 34 as a rough standard. Therefore, by mounting the back lid 31 on the body 15 to engage the engaging portion 34 with the detent portion 23 as described later, the lid marking (marking indicia) 35 can be aligned with the 12 o'clock to 6 o'clock direction.

As shown in FIG. 3, the holding ring 36 includes a base portion 36*a* to be superimposed on the first lid receiving surface 24, the cover portion 36*b* to be superimposed on the annular projection 33 so as to cover the wall portion 20, and a thread 37 formed on an inner peripheral surface of a portion between these portions.

The inner diameter of the cover portion 36*b* is equal to the diameter of a portion of the lid plate 32 other than the annular projection 33, and the thickness of the cover portion 36*b* is equal to the thickness of the portion other than the annular projection 33 described above, that is, the thickness from the front surface of the lid plate 32 to the annular projection 33. The thread 37 is meshed with the thread 18 of the body 15. A surface of a peripheral portion of the holding ring 36 is formed with engaging grooves 38 for engaging a tool (not shown) for turning the holding ring 36 equidistantly along the circumference direction as shown in FIG. 2.

Subsequently, the sequence for fixing the back lid 31 on the back side of the body 15 will be described. In this case, the water-proof packing 22 is fitted to the groove 21 of the body 15 in advance.

First of all, the peripheral portion of the lid plate 32 is superimposed on the second lid receiving surface 19 of the lid mounting portion 17 of the body 15 to close the interior 15*a* of the body 15 from the backside of the body 15. In this case, since the annular lid plate 32 is fitted deep inside the annular wall portion 20 of the lid mounting portion 17, the lid plate 32 can be positioned radially with respect to the body 15 and the lid plate 32 can be superimposed on the second lid receiving surface 19.

At the same time as this operation, the engaging portion 34 of the lid plate 32 is engaged with the detent portion 23 of the lid mounting portion 17 from above. In this case, the engaging portion 34 is not covered with the lid plate 32, and the detent portion 23 of the wall portion 20 is not covered with the lid plate 32, the engaging portion 34 can be engaged with the detent portion 23 easily while viewing the engaging portion 34 and the detent portion 23.

With this engagement, the lid plate 32 is positioned with respect to the circumferential direction of the body 15. In other words, the lid plate 32 is held so as not to be rotated with respect to the body 15.

The detent portion 23 and the lid marking 35 on the front surface of the lid plate 32 are correlated with each other in such a manner that the lid marking 35 is aligned with the 12 o'clock to 6 o'clock direction of the hour plate 13 in the state in which the engaging portion 34 is engaged with the detent portion 23 in advance, the lid marking 35 of the lid plate 32 is positioned in a state of being aligned with the 12 o'clock to 6 o'clock direction of the wristwatch 11 by arranging the lid plate 32 as described above with respect to the lid mounting portion 17.

Subsequently, the thread 37 of the holding ring 36 is meshed with the thread 18 of the lid mounting portion 17, and the holding ring 36 is screwed therein. The screwing is achieved by engaging the tool, not shown, of the engaging groove 38 and rotating the holding ring 36 in a tightening direction.

Accordingly, the cover portion 36*b* which serves as a portion of the holding ring 36 on the side of the inner peripheral portion clamps the annular projection 33 of the lid plate 32 in cooperation with the second lid receiving surface 19 of the body 15, and simultaneously, the base portion 36*a* of the holding ring 36 comes into tight contact with the first lid receiving surface 24 of the body 15, whereby the holding ring 36 is mounted on the lid mounting portion 17. In other words, the back lid 31 is assembled and, simultaneously, the back lid 31 is fixed to the body 15.

In this case, in association with the rotational operation of the holding ring 36, a rotational force of the holding ring 36 acts on the lid plate 32. Irrespective of this configuration, since the engaging portion 34 of the lid plate 32 is engaged with the detent portion 23 of the body 15, the lid plate 32 is not rotated in association with the holding ring 36. Therefore, the state in which the lid marking 35 is aligned with the 12 o'clock to 6 o'clock direction is maintained.

As is clear from the sequence as described above, the back lid 31 can be fixed to the body 15 while maintaining the state in which the lid marking 35 is aligned with the 12 o'clock to 6 o'clock direction, with such simple labor as engaging the engaging portion 34 of the lid plate 32 with the detent portion 23 of the lid mounting portion 17. Therefore, assembly with the orientation of the lid marking 35 of the back lid 31 aligned with the 12 o'clock to 6 o'clock direction of the wristwatch 11 is achieved without the necessity of a back lid 31 alignment correcting operation.

Since the back surface of the peripheral portion of the lid plate 32 comes into tight contact with the water-proof packing 22 in association of the assembly as described above, the water-proof packing 22 is compressed. Therefore, entry of water from the side of the back lid 31 into the interior 15*a* of the body 15 can be prevented by the water-proof packing 22.

In this case, in order that water passed through a portion between the lid plate 32 and the cover portion 36*b* of the holding ring 36 reaches the water-proof packing 22, the annular wall portion 20 and the second lid receiving surface 19, it needs to flow along the annular projection 33 of the lid plate 32. Also, in order that water passed through a portion between the holding ring 36 and the first lid receiving surface 24 of the body 15 reaches the water-proof packing 22, it needs to flow along the annular wall portion 20 of the body 15 to which the annular projection 33 is in contact. Anyway, since an entry path of water up to the water-proof packing 22 assumes a labyrinth shape, improvement of waterproof properties with respect to the interior 15*a* of the body 15 on the side of the back lid 31 is achieved.

In this embodiment, the detent portion 23 is formed by a depression or concavity provided on the annular wall portion 20. Therefore, when fabricating the detent portion 23 on the wall portion 20, the detent portion 23 can be fabricated easily by performing a working to depress the position to be provided with the detent portion 23 by cutting or the like with respect to the wall portion 20. In contrast, when providing the detent portion 23 so as to project from the inner periphery of the annular wall portion 20, the inner peripheral portion of the wall portion 20 is removed by cutting by a depth corresponding to the projecting dimension of the detent portion 23 while remaining the detent portion 23 formed of the projection, much expense in time and effort is required for the cutting.

In addition, in this embodiment, the engaging portion 34 of the lid plate 32 is formed of the projection projecting from the annular projection 33. Therefore, the engaging portion 34 can be provided on the lid plate 32 simultaneously with punching the lid plate 32 via the press work.

Therefore, workability for forming the detent portion 23 and the engaging portion 34 is good and so that reduction of the fabrication cost is achieved.

As described above, the back lid 31 includes the two components of the lid plate 32 and the holding ring 36. Therefore, the lid plate 32 and the holding ring 36 can be formed of different material respectively according to the usage of the wristwatch 11. In addition, irrespective of whether the lid plate 32 and the holding ring 36 are formed of the same metallic material or not, these components can be applied with the finishing process as independent components, and provided with different colors. In order to provide different colors on the peripheral portion of the back lid and a center portion surrounded thereby as one component, it is necessary to apply a masking on one of these components and to color the other component, which is not preferable in that labor effectiveness is poor and the manufacturing cost is increased.

In the wristwatch 11 of the configuration as described above, the back lid 31 is fixed to the body 15 by directly screwing the holding ring 36 of the back lid 31 to the body 15. Therefore, it is not necessary to provide interposed components or other components formed by combining a plurality of members between the back lid 31 and the body 15 specifically as in Patent Document 1. Therefore, the number of components and the number of steps are small and, in this respect, the cost down is possible. In addition, by being not necessary to provide a space for disposing the interposed components by not using the interposed components, it is advantageous when reducing the outline of the watch sheath assembly 12.

What is claimed is:

1. A portable watch comprising:

an annular body having an interior, a front side, and a back side and containing a time display portion at the front side that displays time; and a back lid screwed into the back side of the body to close the interior of the body from the back side thereof and formed with a lid marking arranged so as to be aligned with a 12 o'clock to 6 o'clock direction of a the time display portion, wherein the body includes an annular lid mounting portion having a thread and a lid receiving surface on the side of the interior of the body with respect to the thread, the back lid includes a lid plate having an annular projection that extends around the lid plate in a circumference direction, the back lid being superimposed on the lid receiving surface and having the lid marking on a front surface thereof, and a holding ring having a thread meshed with the thread, the holding ring being mounted on the lid mounting portion by screwing the same and clamping the annular projection in cooperation with the lid plate to fix the lid plate, and the lid mounting portion includes a detent portion, the lid plate includes an engaging portion engageable with the detent portion, and the lid marking on the front surface of the back lid aligns with the 12 o'clock to 6 o'clock direction in a state in which the engaging portion and the detent portion engage with each other.

2. A portable watch according to claim 1;

wherein the lid mounting portion includes an annular wall portion which partitions the lid receiving portion and allows the annular projection to be fitted therein, and the detent portion is provided on the wall portion.

3. A portable watch according to claim 2; wherein the detent portion comprises one or more depressions opened on an end surface and an inner peripheral surface of the wall portion, and the engaging portion comprises a projection projecting from the annular projection.

4. A portable watch according to claim 2; wherein the lid mounting portion has an annular groove opening on the lid receiving surface positioned on the side of the interior of the body with respect to the thread of the lid mounting portion, and an annular water-proof packing is fitted into the annular groove in tight contact with a back surface of the lid plate.

5. A portable watch according to claim 1; wherein only one engaging portion is provided at a peripheral portion of the lid plate so as to be visible, and the lid marking on the front surface of the back lid is positioned so as to be aligned with the 12 o'clock to 6 o'clock direction in correlation with the engaging portion in the state in which the engaging portion engages with the detent portion.

6. A portable watch comprising:

an annular watch case body having a front side and a back side, the back side having a lid-receiving surface extending circumferentially therearound and a concavity that opens at the lid-receiving surface;

a time display portion at the front side of the watch case body that displays time;

a back lid disposed on the lid-receiving surface of the watch case body to close the interior of the watch case body from the back side thereof, the back lid having marking indicia and a projection that engages with the concavity in the back side of the watch case body to position the back lid in a predetermined position in which the marking indicia align with the 12 o'clock to 6 o'clock direction of the time display portion; and a holding ring threaded onto the watch case body with the back lid clamped therebetween to removably attach the back lid to the watch case body while maintaining the back lid in the predetermined position.

7. A portable watch according to claim 6;

wherein the watch case body has at the back side thereof an annular recessed portion in which is disposed the back lid, the recessed portion having a first surface that constitutes the lid-receiving surface and a second surface that abuts a peripheral outer edge of the back lid, the concavity being formed in the second surface.

8. A portable watch according to claim 7; wherein the first and second surfaces are generally perpendicular to each other.

9. A portable watch according to claim 6; wherein the watch case body has at the back side an annular wall portion that separates a first annular surface from a second annular surface, the first annular surface constituting the lid-receiving surface and the second annular surface constituting a ring-receiving surface that receives the holding ring.

10. A portable watch according to claim 9; wherein the first annular surface is situated radially inwardly of the annular wall portion and the second annular surface is situated radially outwardly of the annular wall portion.

11. A portable watch according to claim 10; wherein the annular wall portion has a threaded section onto which is threaded the holding ring.

12. A portable watch according to claim 11; wherein the holding ring has a cover portion that covers a peripheral portion of the back lid around the circumference thereof to clamp the back lid between the cover portion and the lid-receiving surface when the holding ring is threaded onto the threaded section of the annular wall portion.

13. A portable watch according to claim 12; wherein the cover portion covers the projection and the concavity.

14. A portable watch according to claim 9; wherein the first annular surface has an annular groove, and an annular water-proof packing is fitted into the annular groove.

15. A portable watch according to claim 9; wherein the first and second annular surfaces are flat surfaces that are not coplanar with each other.

16. A portable watch according to claim 6; wherein the height of the projection in the thickness direction of the portable watch is greater than the height of the concavity in the thickness direction.

17. A portable watch according to claim 6; wherein the back lid has only one projection that engages with a concavity in the back side of the watch case body.

* * * * *